US006823785B2

(12) United States Patent
Schneider et al.

(10) Patent No.: US 6,823,785 B2
(45) Date of Patent: Nov. 30, 2004

(54) PRINTING UNIT

(75) Inventors: Georg Schneider, Würzburg (DE); Wolfgang Otto Reder, Veitshöchheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/380,174

(22) PCT Filed: Sep. 17, 2001

(86) PCT No.: PCT/DE01/03561

§ 371 (c)(1),
(2), (4) Date: Mar. 19, 2003

(87) PCT Pub. No.: WO02/24455

PCT Pub. Date: Mar. 28, 2002

(65) Prior Publication Data

US 2004/0011230 A1 Jan. 22, 2004

(30) Foreign Application Priority Data

Sep. 20, 2000 (DE) ..... 100 46 374
Sep. 20, 2000 (DE) ..... 100 46 370

(51) Int. Cl.[7] ..... B41F 13/02

(52) U.S. Cl. ..... 101/219; 137/183; 137/247; 137/425; 137/484; 137/492

(58) Field of Search ..... 101/484, 492, 101/137, 139, 148, 171, 177, 182–184, 211, 216, 219, 225, 247, 350.3, 181

(56) References Cited

U.S. PATENT DOCUMENTS 4,960,048 A * 10/1990 Sarda ..... 101/182
5,103,730 A * 4/1992 Sarda ..... 101/425
5,447,102 A * 9/1995 Pfeiffer et al. ..... 101/492
5,617,788 A 4/1997 Horiguchi et al.
5,660,108 A * 8/1997 Pensavecchia ..... 101/137
5,787,806 A * 8/1998 Seyfried et al. ..... 101/181
5,983,793 A 11/1999 Volz et al.
5,983,794 A 11/1999 Emery
6,032,579 A 3/2000 Richards
6,032,582 A * 3/2000 Franz et al. ..... 101/484
6,055,907 A * 5/2000 Endisch et al. ..... 101/484
6,332,397 B1 12/2001 Bolza-Schünemann et al.
6,408,748 B1 6/2002 Hajek et al.
6,446,553 B1 * 9/2002 Costin et al. ..... 101/183
6,499,402 B1 * 12/2002 Sikes et al. ..... 101/484
6,543,354 B1 * 4/2003 Straube et al. ..... 101/247
6,578,481 B1 * 6/2003 Beisel ..... 101/350.3

FOREIGN PATENT DOCUMENTS

| | | |
|---|---|---|
| DE | 44 30 693 A1 | 3/1996 |
| DE | 197 32 330 A1 | 2/1997 |
| DE | 196 03 663 A1 | 8/1997 |
| DE | 196 40 649 A1 | 4/1998 |
| DE | 197 23 043 A1 | 12/1998 |
| DE | 197 33 644 A1 | 2/1999 |
| DE | 198 22 893 A1 | 11/1999 |
| EP | 0 621 133 A1 | 10/1994 |
| EP | 0 997 273 A2 | 5/2000 |
| JP | 63125336 A | 5/1988 |

OTHER PUBLICATIONS

"Digitaler Direktantrieb an Druckmaschinen," Druckspiegel, Sep. 1999, pp. 53–56.

* cited by examiner

*Primary Examiner*—Eugene H. Eickholt
(74) *Attorney, Agent, or Firm*—Jones, Tullar & Cooper, P.C.

(57) ABSTRACT

A printing unit has at least four cylinders that form a printer. At least two of these four cylinders rotate independently of each other. At least one of the cylinders in the group of at least four cylinders has a set up rotational speed that is not zero and that is different from a production rotational speed of that cylinder.

29 Claims, 3 Drawing Sheets

PRINTING UNIT

FIELD OF THE INVENTION

The present invention is directed to a printing unit The printing unit has at least four cylinders that form two pairs. Transfer cylinders of the two pairs cooperate in a print-on position.

BACKGROUND OF THE INVENTION

A four-cylinder printing unit is known from DE 196 03 663 A1. Two transfer cylinders which cooperate with each other are fixedly coupled to each other and can be selectively driven by the drive mechanism of one or of both associated forme cylinders, or via a transverse shaft which can be connected to the motors. In one mode of operation, one of the forme cylinders can be stopped for a plate change, while the associated transfer cylinder continues to run synchronously with the second forme cylinder.

EP 0 997 273 A2 discloses a mode of operation of a four-cylinder printing unit a forme cylinder is moved away from the remaining cooperating cylinders. In one example, the moved-away forme cylinder can be rotated by a drive motor, and in another example it can be rotated by an auxiliary motor.

A printing unit with two pairs of cylinders is known from EP 0 621 133 A1. Each of the cylinders of at least one pair has its own drive motor, which is independent of the remaining cylinders.

In accordance with the article "Digitaler Direktantrieb an Druckmaschinen" [Direct Digital Drive for Printing Presses], in Druckspiegel September 1999, cylinders and rollers can be separately controlled, for example in the course of independent change of several printing plates or while changing a rubber blanket, wherein the remaining units are stopped. It is also possible to operate each printing location, or printing group, independently of the others.

SUMMARY OF THE INVENTION

The object of the present invention is directed to providing a printing unit.

In accordance with the present invention, this object is attained by providing a printing unit with at least four cylinders that include a first pair with a first forme cylinder and a first transfer cylinder, as well as a second pair with a second forme cylinder and a second transfer cylinder. The two transfer cylinders cooperate in a print-on position. At least one of the transfer cylinders has a set-up rotational speed which differs from a production rotational speed and from zero. The associated forme cylinder also has a set-up rotational speed which differs from the production rotational speed and from a zero rotational speed.

The advantages which can be obtained by the present invention reside, in particular, in that a large operational diversity and variability of a printing unit or a cylinder assembly is created.

For example, it is possible in this way to move cylinders or groups of cylinders independently of each other at different rotational speeds, or also in different directions of revolutions, which may be required, for example, for a printing forme or for a rubber blanket change, when drawing in a paper web, or in the course of independent inking or washing of rollers and cylinders. In particular, different actions when setting up at set-up rotational speeds, or speeds different from the stop or zero rotational speed, or the production rotational speed for the individual cylinder types are therefore possible next to each other and with a paper web either running or stopped.

The simultaneous meeting of several different demands made on different components of a printing group or a printing unit is particularly advantageous by use of the printing unit in accordance with the present invention. For one, the operational modes contribute to time savings and therefore to a lowering of the production costs, and furthermore make possible the performance of various set-up operations at production speed or at draw-in speed of the running paper web. A flying plate change for single- or doubled-sided imprint operations is possible. For example, in advantageous operational states, a printing forme is changed or pre-inked, while the associated transfer cylinder continues to rotate at production speed. Washing, pre-inking or also a change of the dressing can take place.

An advantageous mode of operation of the printing unit, in the case of two pairs, each having a forme and a transfer cylinder, is the rotation of one of the forme cylinders at a setup rotational speed, while the remaining cylinders continue to rotate at production rotational speeds. Also, both transfer cylinders can be stopped or can rotate at a rotational speed for drawing in a paper web, or at production rotational speed while one of the forme cylinders, or both, are inked.

Variable operational modes are also provided, in an advantageous manner for four-cylinder printing units, and in particular for eight-cylinder printing units which are constituted by two four-cylinder printing units, in particular in respect to a flying plate change, or to an imprinter functionality. For example, the printing operation can be maintained, while one or several forme cylinders, whose rotational speed and also direction of rotation in part is different from the production rotational speed, are changed.

For example, a Y- or a lambda-shaped six-cylinder printing unit can be flexibly employed for a 2/1 print run, or also for a flying plate change, or for a imprint function during 1/1 printing, if one of the forme cylinders is operated at a rotation speed and in a direction of rotation for the change, while all of the remaining cylinders rotate at a production rotational speed. The transfer cylinder assigned to the forme cylinder to be changed is, for example, operated at the same time at a rotational speed and in a direction of rotation for washing, or for other set-up functions. This correspondingly also applies to a seven-, nine- or ten-cylinder printing unit.

For reasons of flexibility and of savings of time, as well as of waste, the operational states provided by the printing unit of the present invention are of great importance in the course of fitting prior to start-up, or at the end of the printing operation. For example, the forme cylinder and the transfer cylinder can simultaneously pass through different set-up programs.

The independent operation of the rollers for ink application, which are assigned to the forme cylinders, is also advantageous. For example, washing or pre-inking can take place regardless of the rotational speed and the direction of rotation of the forme cylinder and while the forme cylinder also passes through a set-up program.

BRIEF DESCRIPTION OF DRAWINGS

Preferred embodiments of the present invention are represented in the drawings and will be explained in greater detail in what follows.

Shown are in.

DESCRIPTION OF THE PREFERRED EMBODIMENTS

Figure 1:
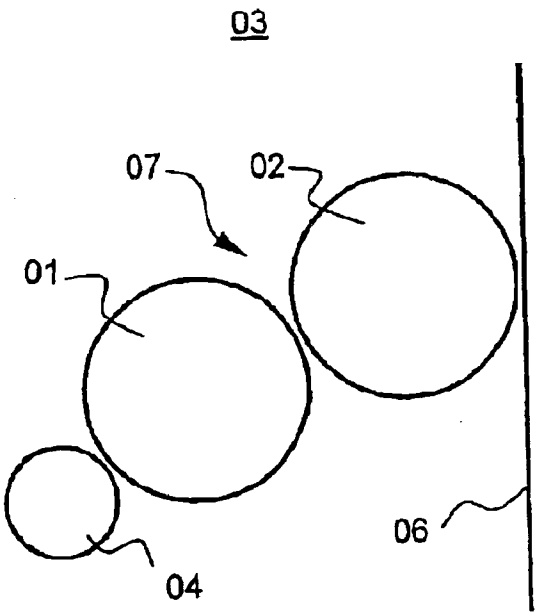
FIG. 1, a schematic view of a forme and transfer cylinder of a printing group with an associated roller in accordance with the present invention, FIG. 2, a schematic view of a four-cylinder printing unit, FIG. 3, a schematic view of a six-cylinder printing unit, FIG. 4, a schematic view of an eight-cylinder printing unit, FIG. 5, a schematic view of a four-cylinder printing unit with the forme cylinder moved away, and in FIG. 6, a schematic side elevation view of a four-cylinder printing unit with two forme cylinders moved away.

A printing unit of a printing press, in particular a rotary printing press, as shown in FIG. 1, has a first cylinder 01, for example a forme cylinder 01, and a second cylinder 02 cooperating with the forme cylinder 01 in a print-on position. The second cylinder 02 may be, for example, a first transfer cylinder 02 of a printing group 03. The forme cylinder 01 can cooperate with an inking roller 04, in particular an ink application roller 04, a screen roller 04, or an anilox roller 04. In a print-on position, the transfer cylinder 02 cooperates with a web 06, for example a web 06 of material to be imprinted, and in particular, a paper web 06.

The forme cylinder 01 can be rotated independently of the transfer cylinder 02, as a function of the operational state of the printing united. It can rotate at times at rotational speeds and/or directions of rotation which are different from the transfer cylinder 02. The transfer cylinder 02 also rotates independently of the forme cylinder 01 at times.

In what follows, the operational states of the printing unit are defined by the rotational speed or by the effective circumferential speed on the surfaces, which are called "speeds" for short in what follows. The operational states mentioned by means of the term "rotational speed" are to be applied in the same way as the term "speed".

The forme cylinder 01 can assume one, or several of the following operational states: it can be stopped, i.e. it rotates at a rotational speed "zero" NFZ. It can also rotate at a production rotational speed RFZ or a set-up rotational speed RFZ which, as a rule, is different from the stopped state NFZ and the production rotational speed PFZ.

The set-up rotational speed RFZ, in turn, can be a rotational speed DWFZ required for a change of the printing forme, a rotational speed VEFZ required for pre-inking, or a rotational speed WFZ required for washing. A further set-up rotational speed RFZ can also be a rotational speed TFFZ necessary for dry running, i.e. a speed necessary for accomplishing ink removal from the forme cylinder 01 on the web 06, or a rotational speed EFZ for use in drawing in the web 06. In the case of a direct image transfer to the surface of the forme cylinder 01 or onto the printing forme on the forme cylinder 01, the set-up rotational speed RFZ can also represent a rotational speed BBFZ required for image transfer.

The transfer cylinder 02 can also selectively assume one or several of the following operational states. It can be stopped, so that it rotates at a rotational speed "zero" NÜZ, it can rotate at a production rotational speed PÜZ or a set-up rotational speed RÜZ, which, as a rule, is also different from both the NFZ and the production rotational speed PFZ. The set-up rotational speed RÜZ can again be a rotational speed AWÜZ for changing the dressing, a rotational speed EÜZ for drawing in a web 06, a rotational speed WÜZ for washing, or a rotational speed VEÜZ for pre-inking the transfer cylinder 02.

The production rotational speed PFC for the forme cylinder 01 lies, for example, between 20,000 and 50,000 revolutions per hour (r/h), and preferably between 35,000 to 45,000 r/h. The production rotational speed PÜZ of the transfer cylinder 02 also lies between 20,000 and 50,000 r/h, and preferably at 35,000 to 45,000 r/h.

The rotational speed VEFZ of the forme cylinder 01 characteristic for pre-inking, for example, lies in the range between 6,000 and 12,000 r/h.

The rotational speed VEÜZ of the transfer cylinder 02 lies, for example, between 6,000 and 12,000 r/h.

For washing the forme cylinder 01, the rotational speed WFZ, for example, lies between 200 to 1,000 r/h, and in particular between 300 and 800 r/h, while the rotational speed WÜZ for washing the transfer cylinder 02 can lie between 300 and 40,000 r/h, for example, and in particular between 300 to 6,000 r/h.

The rotational speed EFZ, for example, of the forme cylinder 01 turning along for drawing in the web 06 lies between 600 and 2,000 r/h, for example, and in particular between 300 to 800 r/h, which approximately corresponds to a draw-in speed of the web 06 between 6 to 30 m/min, and in particular between 6 to 12 m/min.

The rotational speed EÜZ of the transfer cylinder 02 for drawing in the web 06 is, for example, 300 to 2,000 r/h, and in particular between 300 to 800 r/h, which rotational speed approximately corresponds to a draw-in speed of the web 06 between 6 to 30 m/min, and in particular between 6 to 12 m/min.

To accomplish an automatic change of a printing forme on the forme cylinder 01, the rotational speed DWFZ of the forme cylinder 01 can lie between 300 r/h and 2,000 r/h, and in particular between 300 r/h and 1,000 r/h, wherein, as a rule, a reversal of the direction of rotation of the forme cylinder 01 also takes place during the changing process. However, the rotational speed DWFZ of the forme cylinder 01 can also lie between 120 and 300 r/h during a so-called tip operation. With a direct image transfer to the print forme or to the outer cylinder surface of the forme cylinder 01, for example by use of laser diodes, the rotational speed BBFZ of the forme cylinder 01 as a rule lies above the production rotational speed PFZ, for example above 50,000 r/h, and in particular above 70,000 r/h for web-fed printing presses, and above 5,000 r/h, and in particular between 5,000 and 30,000 r/h, for sheet printing presses.

The rotational speed AWÜZ for changing the dressing or blanket on the transfer cylinder 02 lies between 300 and 2,000 r/h, and in particular between 300 and 1,000 r/h. If the change of the dressing is performed manually, which is preferred at present, the rotational speed of the transfer cylinder 02 can also lie between 120 and 1,000 r/h.

The rotational speed TFFZ of the forme cylinder 01 for dry running, such as required for ink removal from the forme cylinder 01, lies between 2,000 and 4,000 r/h.

The rotational speeds for the forme cylinders 01 and for the transfer cylinders 02 preferably relate to cylinders 01, 02 each of double circumference, i.e. to cylinders 01, 02 on each of whose circumference two printing forms can be fastened, one behind the other in the circumferential direction of the cylinder. The circumferences for this are a function of the production format and lie, for example, between 900 mm and 1,300 mm. The rotational speeds of the forme cylinder 01, 02 would have to be doubled in case of the use of cylinders 01, 02 of single circumference. This correspondingly applies to printing groups 03, wherein a forme cylinder 01 of single circumference cooperates with a transfer cylinder 02 of double or twice the circumference.

For one or for several of the rotational speed ranges of the forme cylinder 01 and the transfer cylinder 02 discussed above, either left or right directions of rotation are possible. These directions of rotation are defined in the subsequent drawing figures which depict side elevation views of the cylinders 01, 02.

The above-mentioned operational states, as well as the discussed preferred rotational speeds, should also be applied to further forme cylinders, transfer cylinders added in the course of the subsequent description.

The inking roller 04, which is embodied as a screen or as an anilox roller 04, or as a rubber-coated ink application roller 04, can also either be stopped, so that it rotates at a rotational speed "zero" NW, or it can operate at a production rotational speed PW, or at a set-up rotational speed RW. The setup rotational speed RW can be a rotational speed VEW suitable for pre-inking, a rotational speed WW usable for washing, or a rotational speed WLW intended for the continued running of the inking roller 04.

The preferred rotational speed ranges of the inking roller 04 are a function of the printing process and/or the configuration of the printing unit, or of the inking system.

In the following discussion, a differentiation is to be made between a simple rubber-coated ink application roller 04, an anilox roller 04 or a screen roller 04, as well as a screen roller 04 of twice the circumference. The inking roller 04 embodied as a simple rubber-coated ink application roller 04 preferably has approximately one-third the circumference of a forme cylinder 01 of double circumference. A screen roller 04 that is directly cooperating with the forme cylinder 01, can have the circumference of a forme cylinder 01 of single circumference or, particularly in case of letterpress or flexographic printing, of a forme cylinder 01 of twice the circumference.

For example, the production rotational speed PW lies between 40,000 and 100,000 r/h for the anilox rollers 04 or for the screen rollers 04 of single circumference which are directly cooperating with the forme cylinder 01, and between 60,000 and 150,000 r/h in the case of the ink application roller 04. The production rotational speed PW of the screen roller 04 of twice the circumference lies between 20,000 and 50,000 r/h, for example.

The rotational speed VEW for pre-inking the inking roller 04 lies between 12,000 to 24,000 r/h, for example, in the case of the anilox roller 04 or the screen roller 04 being of single circumference, and between 18,000 and 36,000 r/h in the case of an ink application roller 04.

For washing the inking roller 04, the rotational speed WW, for example, lies between 600 and 1,600 r/h in the case of the anilox roller 04 or the screen roller 04 being of single circumference, and between 900 and 2,400 r/h in the case of an ink application roller 04.

During continued running of the inking roller 04, to counter any drying of the ink, the rotational speed WLW preferably lies between 3,000 and 6,000 r/h for a screen roller 04 of twice the circumference, between 6,000 and 12,000 r/h for a screen roller 04 of single circumference, and between 9,000 and 18,000 r/h for an ink application roller 04.

As mentioned above, the operational states are also defined by effective circumferential speeds, or speeds for short, of the rotating bodies.

The production speed PFZ of the forme cylinder 01 lies between 6.4 and 16 m/s, for example, and in particular between 11 and 15 m/s. The same applies to the transfer cylinder 02, if one is provided.

The speed PWFZ of the forme cylinder 01, used for an automated changing of the printing forme, lies between 0.32 and 0.64 m/s, for example, and for a manual change, for example, lies between 0.10 and 0.32 m/s. For pre-inking the printing forme, the speed VEFZ of the forme cylinder 0.1 lies, for example, between 1.9 and 3.9 m/s, while for washing of the printing forme WFZ it lies between 0.06 and 0.32 m/s, for example, and in particular between 0.10 and 0.26 m/s. During dry running TFFZ of the printing forme, the speed of the forme cylinder 01 lies, for example, between 0.64 and 1.3 m/s. As a rule, the speed of the forme cylinder 01 for image transfer BBFZ is greater than 16 m/s, and in particular is greater than 22 m/s for web-fed printing presses, and for sheet-fed printing presses this speed is greater than 1.6 m/s, and lies, in particular, between 1.6 and 9.6 m/s. For drawing in the web 06, the speed EFZ of the forme cylinder 01 lies, for example, between 0.10 and 0.50 m/s, and in particular lies between 0.10 and 0.2 m/s.

The same values, or ranges of values, are as advantageous for the transfer cylinder 02 as for the forme cylinder 01 for the respective operational states of pre-inking VEÜZ, for changing the dressing AWÜZ and for drawing in the web E ÜZ. The speed AWÜZ of the transfer cylinder 02 for a manual changing of the dressing lies between 0.04 and 0.32 m/s. During washing WÜZ of the transfer cylinder 02, its speed lies, for example, between 0.10 and 13 m/s, and in particular between 0.10 and 1.9 m/s.

The speeds of the inking roller 04 in the operational states where it is placed against the forme cylinder 01 are based on the speed of the latter, so that, for example, the production speed PW of the inking roller 04 also lies in the range between 6.4 and 16 m/s, and in particular between 11 and 15 m/s. If the inking roller 04 is embodied as a screen roller 04, its circumference can then approximately correspond to the circumference of a forme cylinder 01 of single circumference, for example. If the circumference of the screen roller 04 has been selected to be greater, for example between 1.0 and 1.2 m, the above mentioned rotational speeds PW should be selected to be less. This correspondingly applies in the case in which the inking roller 04 is embodied as an ink application roller 04. The rotational speed to be selected is again a function of the inking rollers 04, which, for example, lies between 0.35 and 0.5 m.

For pre-inking, the speed of the inking roller 04 lies, for example, between 1.9 to 4.0 m/s, and for washing the speed lies between 0.08 and 0.3 m/s. For continued running, the speed of the inking roller 04 lies, for example, between 0.95 and 1.95 m/s.

In case where the circumference of the screen roller 04 lies in the lower circumferential range or below, such as is advantageous, for example, in case of a double-sized forme cylinder 01 during direct printing operations, in an advantageous embodiment the above mentioned ranges of the rotational speeds for the screen roller 04 should be increased by the appropriate rotational speed, for example by 0 to 30%, and in particular by 10 to 20%, so that the range for the speed is approximately maintained.

Suitable, or desired rotational speeds for the rotating bodies 01, 02, 04, which are embodied as cylinders 01, 02 and rollers 04, can be determined by the advantageous speeds, if the effective circumferences for various diameters are known.

In the drawing figures, the inking rollers 04 are generalized and are represented with a uniform diameter for the sake of simplicity. The operational states are described by rotational speeds in the preferred embodiments. However, the same embodiments can also be read from the speeds characterizing the operational speeds.

Figure 6:
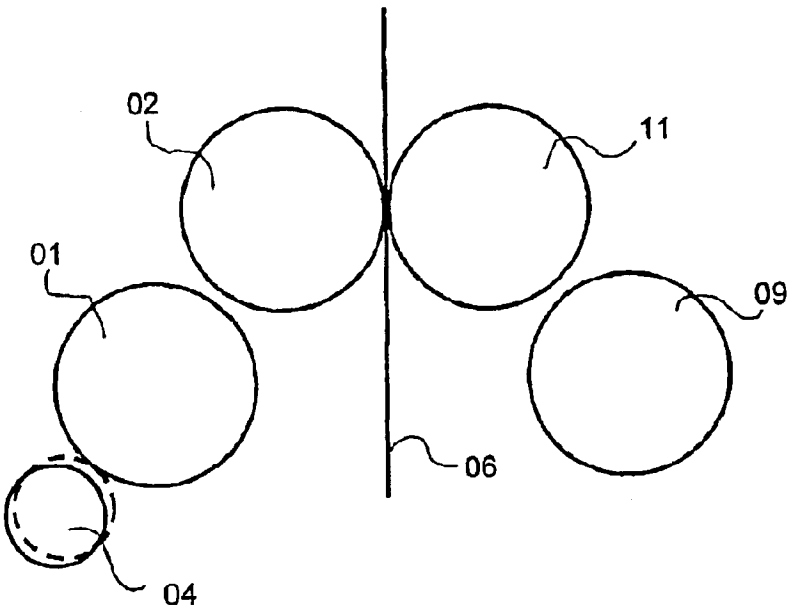

To limit the number of drawing figures, the arrangement of the cylinders 01, 02 and rollers 04 in FIGS. 1 to 4 is represented in which the rotatable bodies 01, 02 and 04 are spaced apart from each other. The states of cylinders 01, 02, or rollers 04, which are placed against or away from each other, ensue from the descriptions of the preferred embodiments and they can therefore not be taken from the mentioned drawing figures alone. FIGS. 5 and 6 represent states described in the preferred embodiments for placing cylinders, or rollers, against or away from each other.

A first group of examples are shown with reference to FIG. 1 and form first to eighth preferred embodiments, and describe advantageous operational states for a first cylinder pair 07 consisting of the forme cylinder 01 and the cooperating transfer cylinder 02.

In a first example, the forme cylinder 01 rotates at the set-up rotational speed RFZ for the purpose of pre-inking, in this case at the rotational speed VEFZ characteristic or required for pre-inking. The transfer cylinder 02 is in the stopped state NÜZ, for example in order not to further convey an already drawn-in web 06, which results in a reduction of waste. The forme cylinder 01 can have a cooperating inking roller 04, which is either coupled with it or, in an advantageous manner, also rotates independently of the forme cylinder 01. In the present preferred embodiment, it rotates in the opposite direction of rotation at the set-up rotational speed RW corresponding to the circumferential speed of the forme cylinder and is placed against the latter. The set-up rotational speed RW, in this case the rotational speed VEW, for pre-inking the inking roller 04 need not be identical to that of the forme cylinder 01. Instead it is a function of the circumferential ratio between the forme cylinder 01 and the inking roller 04.

In a second example, the forme cylinder 01 continues to rotate at the rotational speed VEFZ for pre-inking, while the transfer cylinder 02 rotates at the rotational speed RÜZ corresponding to the rotational speed WÜZ for washing the transfer cylinder.

In a third example, the forme cylinder 01 rotates at the rotational speed VEFZ for pre-inking, while the transfer cylinder 02 rotates at the set-up rotational speed RÜZ corresponding to the rotational speed EÜZ for drawing in the web 06.

In a fourth example, the forme cylinder 01 rotates at the rotational speed RFZ, in this case at the rotational speed DWFZ for changing the printing forme. At the same time, the transfer cylinder 02 rotates at the rotational speed EÜZ for drawing in the web 06. In the case of a direct image transfer to forme cylinders 01, the forme cylinder 01 rotates at the rotational speed BBFZ for transferring images to the forme cylinder 01.

In the fifth example, the forme cylinder rotates at the rotational speed BBFZ for image transfer to the forme cylinder 01, while the transfer cylinder 02 is in the stopped state NÜZ. The forme cylinder 01 and the transfer cylinder 02 are moved away from each other. The inking roller 04 is moved away and is, for example, in the stopped state NW.

In the sixth example, the forme cylinder 01 rotates at the rotational speed DWFZ for changing the printing forme, while the transfer cylinder 02 rotates at the rotational speed WÜZ for washing. Here it is also possible, in the case of a direct image transfer to forme cylinders 01, that the latter alternatively rotates at the rotational speed BBFZ for transferring images. The forme cylinder 01 and the transfer cylinder 02 are moved away from each other. The inking roller 04 is moved away from the forme cylinder 01 and, for example, rotates also at the set-up speed rotational speed RW, the rotational speed VEW for pre-inking, the rotational speed WW for washing the inking roller 04, or the rotational speed WLW for continued running of the inking roller 04 for preventing it from drying out.

In the seventh example, the forme cylinder 01 is in the stopped state NFZ while the transfer cylinder 02 rotates at the rotational speed EUZ for drawing in the web 06. The inking roller 04 can be in or out of contact.

In the eighth example also, the forme cylinder 01 is in the stopped state NFZ, while the transfer cylinder 02, however, rotates at the rotational speed WUZ for washing the transfer cylinder 02. Here too, the inking roller can be in or out of contact.

Figure 2:
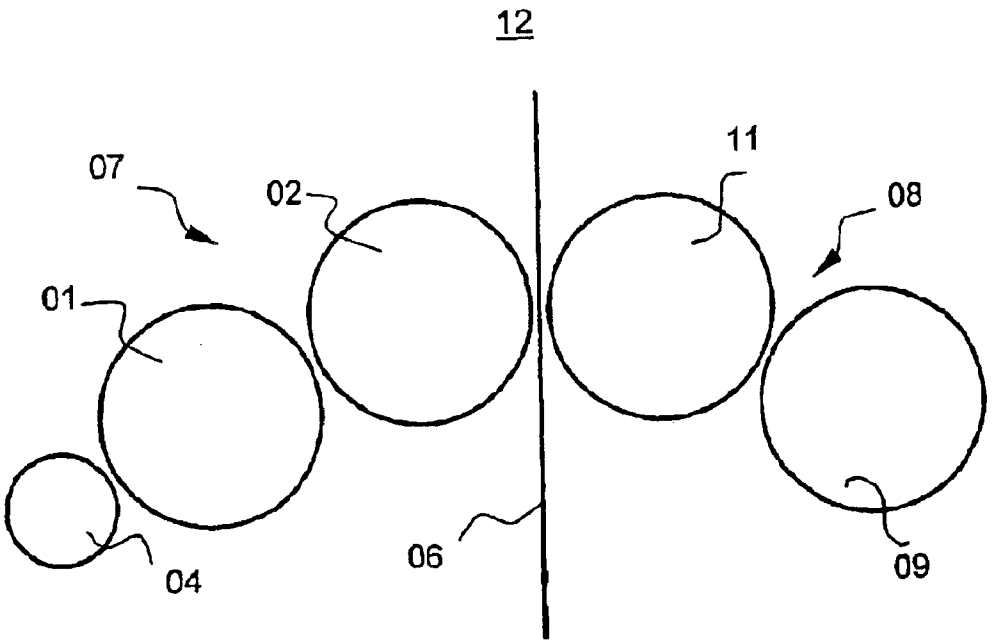

In a group of examples shown in FIG. 2, specifically ninth to fourteenth examples, the first pair 07 cooperates in a print-on position via the web 06 with a second pair 08 of cylinders 09, 11 consisting of, for example, a second forme cylinder 09 and a second transfer cylinder 11. In principle, all of the operational states in the first to eighth examples of the first pair 07 are possible for the second pair 08, parallel and independently of the operational state of the first pair 07. However, the second pair 08 could be mechanically coupled. In what follows, some advantageous operational modes are described for a four-cylinder printing unit 12, for example a bridge printing unit 12.

In a ninth example, the two transfer cylinders 02, 11 are placed against each other and each rotate, together with one of the forme cylinder 09, 01, at the production rotational speed PFZ, PÜZ, while the other one of the two forme cylinder 01, 09 rotates at one of the set-up rotational speeds RFZ. In this case, the set-up rotational speed RFZ represents, for example, the rotational speed BBFZ for image transfer. The forme cylinder 09, 01 rotating at the production rotational speed PFZ is preferably placed against the associated transfer cylinder 11, 02 and rotates in the opposite direction of rotation to the cooperating transfer cylinder 11, 02 which, in turn, rotates in the opposite direction to the other transfer cylinder 02, 11.

In a variation of the ninth example, the forme cylinder 01, 09, which is not rotating at the production rotational speed PFZ can also be rotating at the rotational speed VEFZ for pre-inking the forme cylinder 01, 09.

In a tenth example, the two transfer cylinders 02, 11 rotate at the production rotational speed PÜZ, the same as in the ninth example, while the two forme cylinders 01, 09 rotate at the production rotational speed RFZ, in particular at the rotational speed BBFZ for image transfer, and are moved away from the transfer cylinder 02, 11.

In an also advantageous variation of the tenth example, the forme cylinders 01, 09 are at the rotational speed VEFZ for pre-inking.

In an eleventh example depicted in FIG. 6, the two transfer cylinders 02 and 11 rotate at one of their set-up rotational speeds RÜZ, for example at a rotational speed EÜZ for drawing in the web 06, while both forme cylinders 01, 09 are moved away from each associated transfer cylinder and rotate also at one of their set-up rotational speeds RFZ, for example at the rotational speed PWFZ for changing the printing forme, or alternatively at the rotational speed BBFZ for image transfer. The forme cylinders 01, 09 and the associated transfer cylinders 02, 11 are not placed against each other. The inking roller 04 is also moved away from the forme cylinder 01.

In the same way, and as mentioned in connection with the first eight examples, only one of the forme cylinders 01, 09 can rotate at one of its set-up rotational speed RFZ, while the assocaited transfer cylinder 02, 11 has one of its set-up numbers RÜZ.

In a twelfth example, one of the two forme cylinders 01, 02 from the eleventh example is in the stopped state NFZ.

In the thirteenth example depicted in FIG. 6, the two transfer cylinders 02, 11 are in the stopped state NÜZ, while at least one of the two forme cylinders 01, 09 rotates at the rotational speed VEFZ for pre-inking. In an advantageous embodiment, the inking cylinder 04 shown, in dashed lines in FIG. 6, which also rotates at its rotational speed VEW for inking, is placed against this forme cylinder 01, 09.

In the fourteenth example, also depicted by referring to FIG. 6, both transfer cylinders 02 and 11 rotate at the rotational speed EÜZ for drawing in the web 06, while at least one of the two forme cylinders 01, 09, and preferably both of the forme cylinders 01, 09, are in the stopped state NFZ.

Figure 3:
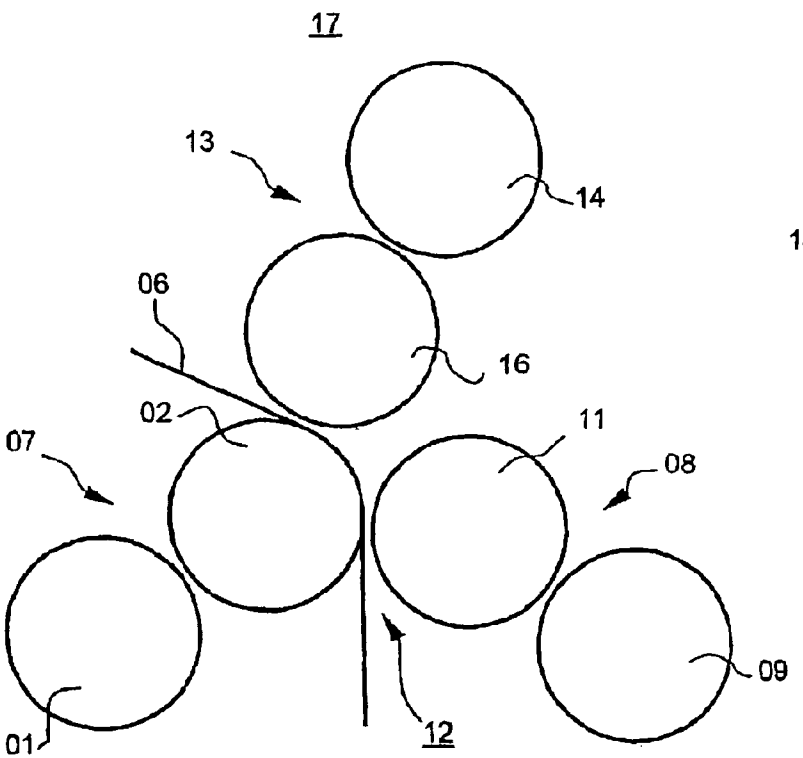

In a third group of examples, specifically examples fifteen to twenty as shown in FIG. 3, a third pair 13 of cylinders 14, 16, consisting, for example, of a third forme cylinder 14 and a third transfer cylinder 16, are or can be placed against either the transfer cylinder 02, or 11 of one of the two pairs 07, 08. In principle, all of the operational states of the first to eight examples are possible for this third pair 13, parallel and independently of the operational state of the first pair 07 or the second pair 08, as well as parallel and independently of the operational states of the four-cylinder printing unit 12. The cylinders 14, 16 of the third pair 13 could also be mechanically coupled with each other, or could be operated in any other way in accordance with the conventional prior art. In what follows, some advantageous modes of operation for a six-cylinder printing unit 17, for example a Y-printing unit 17, or lambda-printing unit 17, will be described.

In a fifteenth example, two of the forme cylinders 01, 09, 14, for example the forme cylinders 01 and 09, as well as the two associated transfer cylinders 02, 11, rotate at the production rotational speed PFZ, PÜZ, while the third forme cylinder 14 rotates at the set-up rotational speed RFZ. In the present example, the associated transfer cylinder 16 is placed against the first transfer cylinder 02 of the first pair 07 and also rotates at the production rotational speed PÜZ.

In the sixteenth example, the third transfer cylinder 16 from the fifteenth example is moved away from the first transfer cylinder 02, as well as from the third forme cylinder 14, and is in the stopped state NÜZ.

In the seventeenth example, the third transfer cylinder 16 from the fifteenth example is moved away from the first transfer cylinder 02, as well as from the third forme cylinder 14 as in the sixteenth example, but rotates at the setup rotational speed RÜZ, and in particular the rotational speed WÜZ for washing the transfer cylinder 02, 11, 16.

In the eighteenth example, the three transfer cylinders 02, 11, 16 rotate at the rotational speed EÜZ for drawing in the web 06, while the forme cylinders 01, 09, 14 are in the stopped state NFZ.

In the nineteenth example, the three transfer cylinders 02, 11, 16 rotate at the rotational speed EÜZ for drawing in the web 06, while at least two of the forme cylinders 01, 09, 14 rotate at the set-up rotational speed RFZ, in particular the rotational speed DWFZ for changing the dressing, or alternatively at the rotational speed BBFZ for image transfer to the forme cylinders 01, 09, 14.

In the twentieth example, the three transfer cylinders 02, 11, 16 are in the stopped state NÜZ, while at least two of the forme cylinders 01, 09, 14 rotate at the set-up rotational speed RFZ, and in particular at the rotational speed BBFZ for image transfer to the forme cylinders 01, 09, 14.

Figure 4:
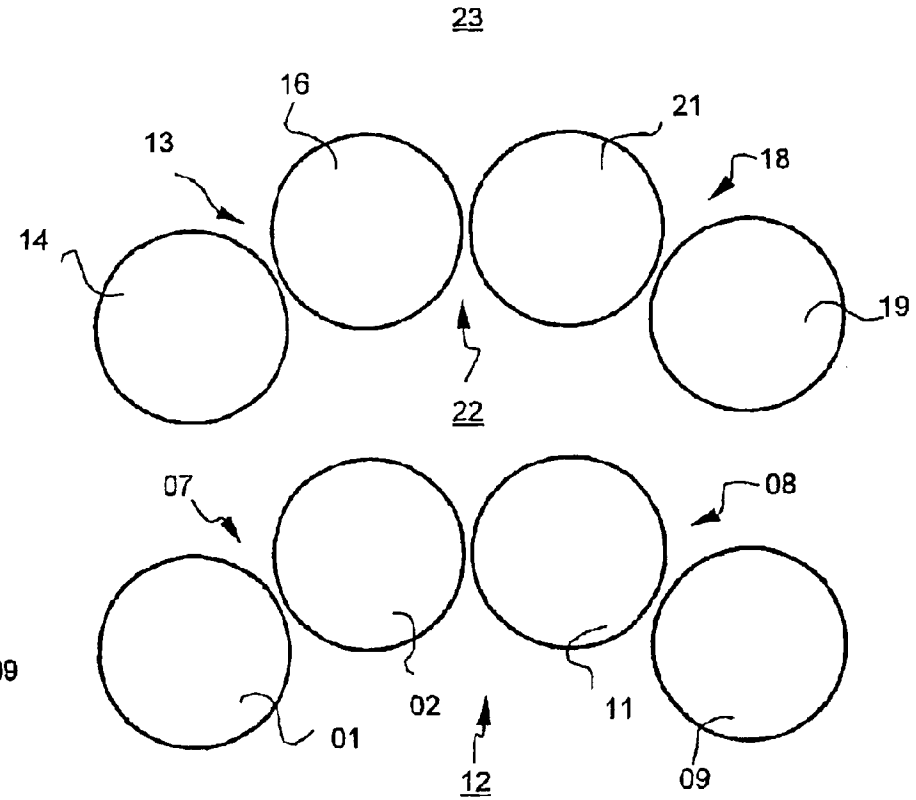
Figure 5:
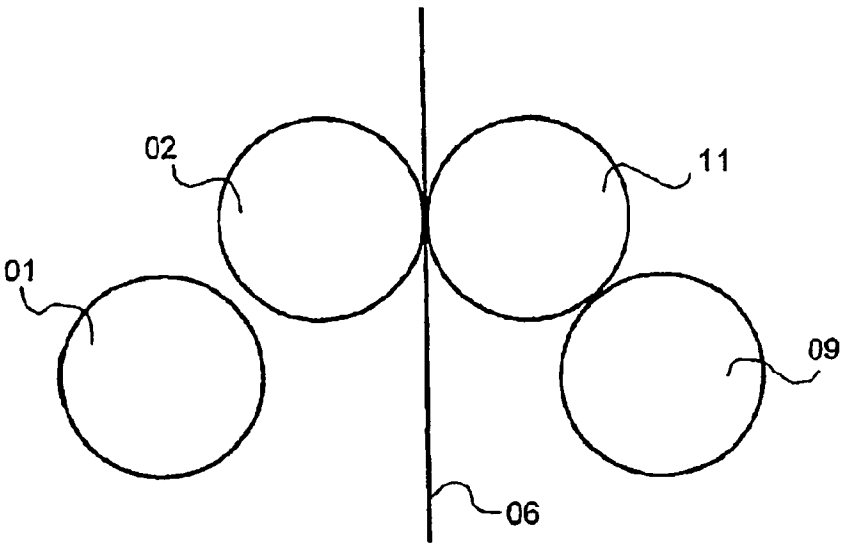

In a fourth group of examples, as shown in FIG. 4 and specifically examples twenty one and twenty eight, the third cylinder pair 13 is not placed against the first or second cylinder pair 07, 08, but instead constitutes a second four-cylinder printing unit 22 together with a fourth pair 18 of cylinders 19, 21, for example a fourth forme cylinder 19 and a fourth transfer cylinder 21. This second four-cylinder printing unit 22, configured, for example as a second bridge printing unit 22, forms an eight-cylinder printing unit 23 together with the first four-cylinder printing unit 12. In principle, all of the operational states in the first to eighth examples, as well as the ninth to fourteenth examples, are possible for the cylinder pairs 13, 18, or for the second four-cylinder printing unit 22, which may be operating parallel and independently of the operational state of the first cylinder pairs 07, 08 or the first four-cylinder printing unit 12.

The cylinders 19, 21 of the fourth cylinder pair 18 can also be operated in any other way in accordance with the conventional prior art, for example they can be mechanically coupled with each other. The two bridge units 12, 22 can be arranged, respectively vertically oriented next to each other, or respectively horizontally oriented on top of each other, or can be mirrored along an imagined horizontal line, forming a so-called H-unit. In what follows, some advantageous modes of operation for the eight-cylinder printing unit 23 are described.

In the twenty-first example, all cylinders 01, 02, 09, 11 of the first lower four-cylinder printing unit 12 which, for example, is vertically oriented, rotate at the production rotational speed PFZ, PÜZ. Also, one of the two pairs 13, 22 arranged at the top, the pair 13 in this example, as well as the transfer cylinder 21 of the fourth pair 18, rotate at the production rotational speed PFZ, PÜZ. The transfer cylinders 02, 11 of the lower four-cylinder printing unit 12, as well as the transfer cylinders 16, 21 have been placed against each other. The forme cylinder 19 of the fourth pair 18 rotates at one of its set-up rotational speeds RFZ, for example at the rotational speed BBFZ for image transfer to the forme cylinders 01, 09, 14, 19. The two transfer cylinders 02, 16 arranged at the left on top of each other, rotate in the same direction of rotation, for example left-rotating, while the two associated transfer cylinders 11, 21 rotate in the opposite direction, for example right-rotating. The respectively associated forme cylinders 01, 09, 14, which rotate at the production rotational speed PFZ, rotate opposite the respective cooperating transfer cylinder 02, 11, 16. Upper and lower four-cylinder printing units 12, 22 can also be interchanged.

In the twenty-second example, all cylinders 14, 16, 19, 21 of the second, for example horizontally oriented upper four-cylinder printing unit 22 rotate at the production rotational speed PFZ, PÜZ. Also, the two transfer cylinders 02, 11, which are arranged at the bottom, of the first or second cylinder pair 07 or 08 rotate at the production rotational speed PÜZ. The transfer cylinders of the lower four-cylinder printing unit 12, as well as the transfer cylinders 16, 21, are each placed against each other. The forme cylinders 01, 09 of the first and second cylinder pair 07, 08 are moved away from the transfer cylinders 02, 11, wherein at least one of the two forme cylinders 01, 09 rotates at one of its set-up rotational speeds RFZ, for example at the rotational speed BBFZ for image transfer to the forme cylinders 01, 09, 14, 19. The upper and lower four-cylinder printing units 12, 22, or the pairs cylinder 07, 08, 13, 18 arranged at the left and right in the examples, can be interchanged.

In a twenty-third example, the cylinders 14, 16, 19, 21 of the upper four-cylinder printing unit 22, as well as the unit 12, rotate at the production rotational speed PFZ, PÜZ. The transfer cylinders 02, 11, 16, 21 are placed in pairs against each other, while the two forme cylinders 01, 09 of the lower four-cylinder printing unit 12 are moved away and rotate at a set-up rotational speed RFZ, in particular the rotational speed BBFZ for image transfer. In an advantageous variation of the twenty-third example, the forme cylinders 01, 09 are in the stopped state NFZ.

In a twenty-fourth example, all four transfer cylinders 02, 11, 16, 21 rotate at one of their set-up rotational speeds RÜZ, for example at the rotational speed EÜZ for drawing in the web 06, which is not specifically represented in FIG. 4, while at least one of the forme cylinders 01, 09, 14, 19, and in an advantageous embodiment at least the two forme cylinders 01, 09, 14, 19 of at least one of the two four-cylinder printing units 12, 22 rotates at one of its set-up rotational speeds RFZ, for example at the rotational speed DWFZ for changing the printing forme, or alternatively at the rotational speed BBFZ for image transfer to the forme cylinders 01, 09, 14, 19. The remaining forme cylinders 19, 14, 09, 01 are, for example, in the stopped state NFZ.

In the twenty-fifth example, all but two cylinders 01, 02, 09, 11, 14, 16, 19, 21 rotate as in the twenty-fourth example, but two forme cylinders 01, 09, 14, 19 of at least one four-cylinder printing unit 12, 22 rotate at the rotational speed VEFZ for pre-inking.

In a twenty-sixth example, each of the cylinders 01, 02, 14, 16, 19, 21 of the three cylinder pairs 07, 13, 18 rotates at the production rotational speed PFZ, PÜZ, while the forme cylinder 09 of the second cylinder pair 08 rotates at one of its set-up rotational speeds RFZ, for example at the rotational speed VEFZ for pre-inking, and the associated transfer cylinder 11 rotates at one of its set-up rotational speeds RÜZ, for example the rotational speed WÜZ for washing of the transfer cylinder 11. However, in this case, the transfer cylinder 11 can also be in the stopped state NÜZ, or can rotate at the rotational speed AWÜZ for the change of the dressing.

In another advantageous alternative of the twenty-sixth example, the forme cylinder 09, which is not at the production rotational speed PFZ, rotates at the rotational speed DWFZ for changing the printing forme or, in the case of a forme cylinder 09 for direct image transfer, at the rotational speed BBFZ for image transfer.

In a twenty-seventh example, all four transfer cylinders 02, 11, 16, 21 are in the stopped state NÜZ, while the two forme cylinders 01, 09, 14, 19 of at least one of the two four-cylinder printing units 12, 22 rotate at the set-up rotational speed RFZ, and in particular at the rotational speed VEFZ for pre-inking the printing form. In an advantageous embodiment, all of the forme cylinders 01, 09, 14, 19 rotate at the rotational speed VEFZ for pre-inking the printing forme.

In a twenty-eighth example, one transfer cylinder 02, 11, 16, 21, for example the transfer cylinder 02, rotates at the set-up rotational speed RÜZ, in particular at the rotational speed WÜZ for washing the transfer cylinder 02, while the associated forme cylinder 01, 09, 14, 19, for example the forme cylinder 01, rotates at one of its set-up rotational speeds RFZ, for example at the rotational speed VEFZ for pre-inking. However, corresponding to the cylinder pair 12 from the first to eighth examples, two transfer cylinders or, corresponding to the ninth to fourteenth examples for the four-cylinder printing unit 12, 22, all four transfer cylinders 02, 11, 16, 21 can be operated at one of their set-up rotational speeds RÜZ, for example WÜZ for washing, and the associated forme cylinders 01, 09, 14, 19 at one of their set-up rotational speeds RFZ, for example the rotational speed VEFZ for pre-inking.

In the described examples, at least the cylinders 01, 02, 09, 11, 14, 16, 19, 21, 24, 32 are driven by their own drive motor. In a preferred embodiment, however, all cylinders 01, 02, 09, 11, 14, 16, 19, 21, 24, 32 of the described printing units can be individually driven by their own drive motors without a driven coupling to another cylinder 01, 09, 11, 14, 16, 19, 21, 24, 32, or inking system. In that case, the drive motors then drive the respective cylinder 01, 02, 09, 11, 14, 16, 19, 21, 24, 32, or the inking system, during set-up operations, as well as during production.

The employment of position-regulated and/or rpm-regulated electric motors is of particular advantage. This also applies to the drives of the rollers 04, which can either have their own drive motor, or the inking system containing the roller 04 has a drive motor, which is independent of the cylinders 01, 02, 09, 11, 14, 16, 19, 21, 24, 32.

While preferred embodiments of a printing unit in accordance with the present invention have been set forth fully and completely hereinabove, it will be apparent to one of skill in the art that changes in, for example, the specific type of web being printed, the overall size of the printing unit, and the like could be made without departing from the true spirit and scope of the present invention which is accordingly to be limited only by the following claims.

What is claimed is:

1. A printing unit with at least four cylinders comprising:

a first cylinder pair including a first forme cylinder and a first transfer cylinder;

a second cylinder pair including a second forme cylinder and a second transfer cylinder, at least said first and second transfer cylinders cooperating in a print-on position of the printing unit; and a separate drive motor for each cylinder in each said cylinder pair, said forme cylinder and said transfer cylinder in each said first and second cylinder pair being driven by their own drive motor and not being in connection with other ones of the cylinders during set-up and production operations of the printing unit, each said individually drive transfer cylinder being operable selectively at one of a plurality of transfer cylinder speeds, including a set-up rotation speed for washing said transfer cylinder or for drawing in a web, a production rotational speed, and a zero rotational speed, said transfer cylinder set-up rotational speed, production rotational speed and zero rotational speed each being different from the others, said forme cylinder in each said cylinder pair being operable selectively at one of a plurality of forme cylinder speeds including a set-up rotational speed, a production rotational speed and a zero rotational speed each being different from the others, said forme cylinder and said transfer cylinder in each said cylinder pair each being simultaneously operable at a selected one of said transfer cylinder speeds and said forme cylinder speeds independently.

2. The printing unit of claim 1 wherein said first and second cylinder pairs form a first four-cylinder printing unit.

3. The printing unit of claim 1 further including a third cylinder pair including a third forme cylinder and a third transfer cylinder, said first, second and third cylinder pairs forming a six-cylinder printing unit.

4. The printing unit of claim 2 further including a second four-cylinder printing unit, said first and second four-cylinder printing units being arranged adjacent each other and forming an eight-cylinder unit.

5. The printing unit of claim 1 wherein said forme cylinder set-up rotational speed is equal to a rotational speed for a change of a printing forme on said forme cylinder.

6. The printing unit of claim 1 wherein said forme cylinder set-up rotational speed is equal to a rotational speed for an image transfer to said forme cylinder.

7. The printing unit of claim 1 wherein said forme cylinder set-up rotational speed is equal to a rotational speed for pre-inking said forme cylinder.

8. The printing unit of claim 1 wherein said forme cylinder set-up rotational speed is equal to a rotational speed for a dry running of said forme cylinder.

9. The printing unit of claim 1 further including a separate one of said drive motors for all cylinders in the printing unit.

10. The printing unit of claim 1 wherein each said separate drive motor is a position-regulated electric motor.

11. The printing unit of claim 1 wherein each said separate drive motor is an rpm-regulated electric motor.

12. The printing unit of claim 1 wherein said production rotational speed is determined by a desired circumferential speed.

13. The printing unit of claim 1 wherein said set-up rotational speed is determined by a desired circumferential speed.

14. A printing unit with at least four cylinders comprising:

a first cylinder pair including a first forme cylinder and a first transfer cylinder;

a second cylinder pair including a second forme cylinder and a second transfer cylinder, at least said first and second transfer cylinders cooperating in a print-on position of the printing unit; and a drive motor for at least each of said transfer cylinder and said forme cylinder in each said at least first and second cylinder pairs, each said drive motor driving its associated cylinder and not being coupled to any one of the cylinders remaining in each said cylinder pair during set-up operation and production of the printing unit, at least each individually driven forme cylinder being operable selectively at one of a plurality of forme cylinder speeds including a set-up rotational speed for pre-inking or image transfer to said forme cylinder, a production rotational speed, and a zero rotational speed, said plurality of forme cylinder speeds all being different from each other, said transfer cylinder in each said cylinder pair being operable selectively at one of a plurality of transfer cylinder speeds including a zero rotational speed and a production rotational speed not equal to said zero rotational speed, said forme cylinder and said transfer cylinder being simultaneously operable at selected ones of said forme cylinder speeds and said transfer cylinder speeds independently.

15. The printing unit of claim 14 wherein said first and second cylinder pairs form a first four-cylinder printing unit.

16. The printing unit of claim 14 further including a third cylinder pair including a third forme cylinder and a third transfer cylinder, said first, second and third cylinder pairs forming a six-cylinder printing unit.

17. The printing unit of claim 15 further including a second four-cylinder printing unit, said first and second four-cylinder printing units being arranged adjacent each other and forming an eight-cylinder unit.

18. The printing unit of claim 14 further including a separate one of said drive motors for all cylinders in the printing unit.

19. The printing unit of claim 14 wherein each said separate drive motor is a position-regulated electric motor.

20. The printing unit of claim 14 wherein each said separate drive motor is an rpm-regulated electric motor.

21. The printing unit of claim 14 wherein said production rotational speed is determined by a desired circumferential speed.

22. A printing unit with at least four cylinders comprising:

a first cylinder pair including a first forme cylinder and a first transfer cylinder;

a second cylinder pair including a second forme cylinder and a second transfer cylinder, said first and second transfer cylinders cooperating in a print-on position of the printing unit; and a drive motor for each of said forme cylinder and said transfer cylinder in each of said at least first and second cylinder pairs, each said drive motor driving its associated cylinder with not driving coupling to another one of said cylinders during set-up and production of the printing unit, at least one of said first and second transfer cylinders having a rotational speed for washing said transfer cylinders or for drawing in a web which differs from a production rotational speed and a zero rotational speed of said transfer cylinder, said associated forme cylinder of said one of said first and second cylinder pairs having a zero rotational speed while said transfer cylinder is in said rotational speed for washing said transfer cylinder or for drawing in a web.

23. The printing unit of claim 22 wherein said first and second cylinder pairs form a first four-cylinder printing unit.

24. The printing unit of claim 22 further including a third cylinder pair including a third forme cylinder and a third transfer cylinder, said first, second and third cylinder pairs forming a six-cylinder printing unit.

25. The printing unit of claim 23 further including a second four-cylinder printing unit, said first and second four-cylinder printing units being arranged adjacent each other and forming an eight-cylinder unit.

26. The printing unit of claim 22 further including a separate one of said drive motors for all cylinders in the printing unit.

27. The printing unit of claim 22 wherein each said separate drive motor is a position-regulated electric motor.

28. The printing unit of claim 22 wherein each said separate drive motor is an rpm-regulated electric motor.

29. The printing unit of claim 22 wherein said production rotational speed is determined by a desired circumferential speed.

* * * * *